US008286626B2

(12) United States Patent
Grobleben et al.

(10) Patent No.: US 8,286,626 B2
(45) Date of Patent: Oct. 16, 2012

(54) KITCHEN EXTRACTOR DEVICE

(75) Inventors: Ralf Grobleben, Bretten (DE); Joachim Gruetzke, New Bern, NC (US); Ulmar Neumann, Forst (DE); Thomas Rembold, Lehrensteinfeld (DE); Thomas Wilde, Stutensee (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 365 days.

(21) Appl. No.: 11/795,528

(22) PCT Filed: Jan. 16, 2006

(86) PCT No.: PCT/EP2006/050227

§ 371 (c)(1),
(2), (4) Date: Jul. 16, 2007

(87) PCT Pub. No.: WO2006/075028

PCT Pub. Date: Jul. 20, 2006

(65) Prior Publication Data

US 2008/0121223 A1 May 29, 2008

(30) Foreign Application Priority Data

Jan. 17, 2005 (DE) ..... 10 2005 002 148

(51) Int. Cl.
*A47J 36/38* (2006.01)
*H05B 6/78* (2006.01)

(52) U.S. Cl. ..... 126/299 R; 126/299 D; 126/273 A; 126/21 A; 219/757

(58) Field of Classification Search ..... 129/299 R, 129/299 D; 126/299 R, 299 D, 21 A, 273 A; 219/757

See application file for complete search history.

(56) References Cited

U.S. PATENT DOCUMENTS

| | | | | |
|---|---|---|---|---|
| 2,449,433 | A * | 9/1948 | Wheelock | 312/290 |
| 3,496,704 | A * | 2/1970 | Bandlow | 96/138 |
| 4,838,422 | A * | 6/1989 | Gregerson | 206/308.1 |
| 5,697,686 | A * | 12/1997 | Miller et al. | 312/194 |
| 6,717,123 | B1 * | 4/2004 | Kim | 219/757 |
| 2005/0173426 | A1 * | 8/2005 | Iwamoto | 219/752 |

FOREIGN PATENT DOCUMENTS

| | | | |
|---|---|---|---|
| DE | 2 206 904 | | 9/1973 |
| DE | 2206904 | B * | 11/1974 |
| DE | 26 54 170 | | 6/1978 |
| DE | 2654170 | A * | 6/1978 |
| DE | 2654170 | A * | 6/1978 |

(Continued)

OTHER PUBLICATIONS

STIC 3700 NPL search report.*

(Continued)

*Primary Examiner* — Steven B McAllister
*Assistant Examiner* — Nikhil Mashruwala
(74) *Attorney, Agent, or Firm* — James E. Howard; Andre Pallapies

(57) ABSTRACT

A kitchen extractor device includes a first body section, designed to be mounted in a fixed manner and a second body section, which can be displaced in a displacement direction in relation to the first body section. The kitchen extractor device comprehensively covers the cooking facilities but nevertheless can be easily cleaned. To achieve this, at least part of the second body section forms an external face of the body that is in transversal alignment with the displacement direction.

36 Claims, 8 Drawing Sheets

FOREIGN PATENT DOCUMENTS

Figure 1:
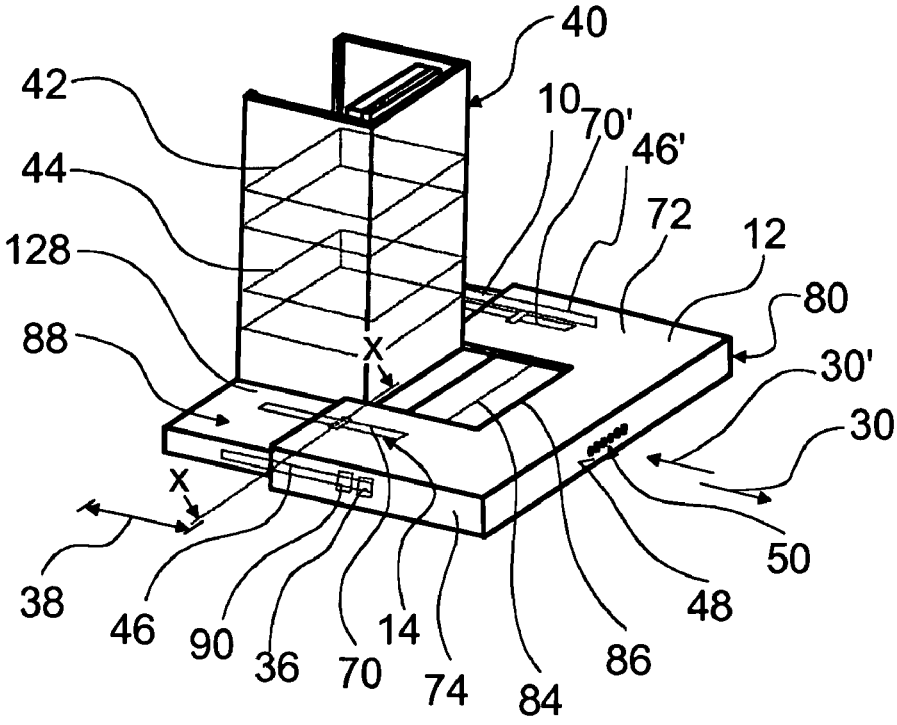

| | | | | |
|---|---|---|---|---|
| DE | 3204068 | A1 | * | 8/1983 |
| DE | 3204068 | A1 | * | 8/1983 |
| DE | 199 06 318 | | | 8/2000 |
| EP | 0 337 935 | | | 10/1989 |
| EP | 0 603 537 | | | 6/1994 |
| EP | 0 727 620 | | | 8/1996 |
| EP | 1418386 | A2 | * | 5/2004 |
| EP | 1 441 182 | | | 7/2004 |
| EP | 1548368 | | * | 10/2004 |
| EP | 1 548 368 | | | 6/2005 |
| EP | 1548368 | | * | 6/2005 |
| EP | 1548368 | A1 | * | 6/2005 |
| EP | 20316130 | | * | 6/2005 |
| FR | 2.089.824 | | | 1/1972 |
| FR | 2649914 | A | * | 7/1989 |
| GB | 1436710 | | * | 5/1976 |

OTHER PUBLICATIONS

International Search Report PCT/EP2006/050227.

* cited by examiner

KITCHEN EXTRACTOR DEVICE

Kitchen extractor devices are known with a body with two sections of the body which are supported to allow movement in relation to each other. A first body section is designed to be mounted in a fixed manner, in a fitted kitchen for example, while the second body section is supported to allow displacement in relation to the first body section.

The object of the invention is especially to provide a kitchen extractor device which comprehensively covers the cooking facilities and which nevertheless can be easily cleaned. The object is achieved in accordance with the advantageous embodiments and developments described herein.

The invention is based on a kitchen extractor device with a body comprising a first body section designed to be mounted in a fixed manner and a second body section able to be moved in a direction of movement relative to the first body section.

It is proposed that at least part of the second body section forms an external face of the body which is in transversal alignment with the displacement direction. This means that a transversal width of a suction area of the kitchen extractor device especially in a front area, can be embodied in an especially large form, enabling the extraction function of the kitchen extractor device to be improved. Furthermore, especially in a pushed-in state, a uniform, easy-to-clean external surface without a visible gap between the two body sections can be obtained.

In this context a direction of a surface normal of the corresponding surface is to be designated as the alignment of a surface. Any surface of the kitchen extractor device directly accessible to an operator is to be seen as an external surface. The kitchen extractor device can be embodied as a chimney cooker hood or also as a built-in extractor hood and is can be used to advantage both in kitchens of private households and also in professional kitchens. The displaceability of the second body section can for example be achieved by a sliding or rolling bearing.

A maximum filter surface can be achieved if at least one filter element is arranged in the second body section and this element moves in conjunction with the movable second body section. This allows the filter element to be especially close to the point of origination of the steam generated in cooking, if the filter element forms at least a part of the external face of the second body part that is in transversal alignment with the displacement direction. Extraction can be made more effective if the corresponding external face forms the underside of the second body section or of the body comprising the two body sections.

A shielding of the first body section by the second body section can be achieved if the second body section at least partly encompasses the first body section or is formed in at least one direction so that it is curved around the first body section.

An essentially complete shielding in a pushed-in state and thus a consequent improvement of the cleaning characteristics as well as a high-quality design which is robust in operation can be achieved if the second body section is intended to be pushed over the first body section. An operator can thus be given the subjective impression that the entire body or the entire kitchen extractor device is displaceable. "Intended" in this context should also be taken to mean "designed" and "equipped".

A deposition of grease particles from the kitchen air onto a less easy to clean upper face of the first body section can be avoided if the second body section in the rest position covers at least a part of a upper face of the first body section.

A continuous, robust-in-operation and easy-to-clean front face of the body can be obtained if the second body section, at least in the rest position, covers at least a part of a front face of the first body section.

If the second body section encompasses the first body section at least in all directions transverse to one direction of movement, an especially secure guidance of the movement can be achieved.

If at least the second body section has a stainless steel surface, an especially robust kitchen extractor device with advantageous cleaning properties can be achieved.

Further scope for moving the second body section while at the same time maintaining an undiminished extraction performance in any position can be achieved if the kitchen extractor device includes a movable cover element relative to the first body section and relative to the second body section for covering an opening arising as a result of a relative movement of the body section.

In this case that opening which is delimited by a recess in the second body section can be advantageously covered which is intended, in the rest position or in the pushed-in configuration, to be penetrated by a steam extraction channel of the first body section. This enables a simple construction to be achieved of a second body section essentially fully enclosing the body in the rest position with at the same time a steam extraction channel running transversely to the direction of movement.

A kitchen extractor device which is convenient to operate can be achieved if the kitchen extractor device has at least one control panel arranged on the second body section. The operating panel can be embodied in any form which appears sensible to the person skilled in the art, for example as a collection of buttons, as a touchpad, as a rotary dial or similar. Embodiments of the invention are also conceivable in which a microphone for implementing voice control of the kitchen extractor device or also of other kitchen devices, for example of a cooker arranged below the kitchen extractor device, is arranged on the second body section. Furthermore the front face can advantageously feature a display for displaying a characteristic value for an operating state of the kitchen device. This is especially advantageous if the kitchen extractor device is arranged at the operator's eye-level height or only a few centimeters below or above this level The control panel on the front of the section can for example be provided for actuation of a fan or of an illumination device of the kitchen extractor device.

In a further embodiment of the invention the second body section features at least one means for holding an illumination device for illuminating devices arranged below the kitchen extractor device. The illumination device advantageously includes spotlights of which the alignment can also be automatically controlled as a function of the position of the second body section. Furthermore embodiments of the invention are conceivable in which at least one switching element is able to be actuated as a function of a displacement of the second body section.

In addition embodiments of the invention are conceivable in which the kitchen extractor device features at least one sensor, for example a smoke or steam sensor, and features a control unit which activates the kitchen extractor unit as a function of a signal of the sensor.

Further advantages emerge from the description of the drawings given below. An exemplary embodiment of the invention is shown in the drawing. The drawing, the description and the claims contain numerous features in combination. The person skilled in the art will expediently also consider the features individually and combine them into useful further combinations.

The figures show:

FIG. 1 a kitchen extractor device with a two-section, extendible body in a locked position viewed at an angle from above, FIG. 2 the kitchen extractor device from FIG. 1 viewed at an angle from below, FIG. 3 the kitchen extractor device from FIGS. 1 and 3 in a rest position viewed at an angle from below, FIG. 4 the kitchen extractor device from FIGS. 1-3 viewed from below, FIG. 5 a section of the kitchen extractor device from FIGS. 1-4 with a locking apparatus and with a cladding means removed, FIG. 6 the section from FIG. 5, with a first body section of the two-section body being shown transparently, FIG. 7 the section from FIGS. 5 and 6, with a support element being shown transparently, FIG. 8 a locking means of the locking apparatus from FIGS. 5-7, FIG. 9 a further locking means of the locking apparatus from FIGS. 5-7, FIG. 10 a part of a guide apparatus of the kitchen extractor device from FIGS. 1-9, in a schematic cross-sectional diagram.

Figure 8:
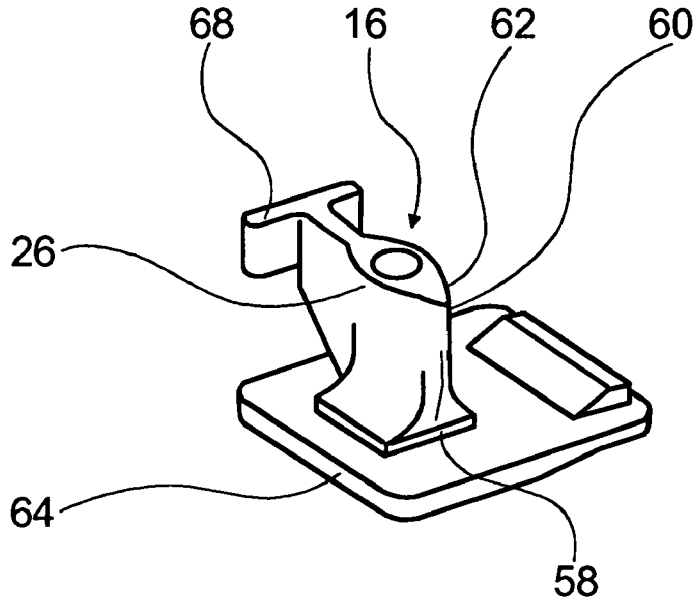
Figure 9:
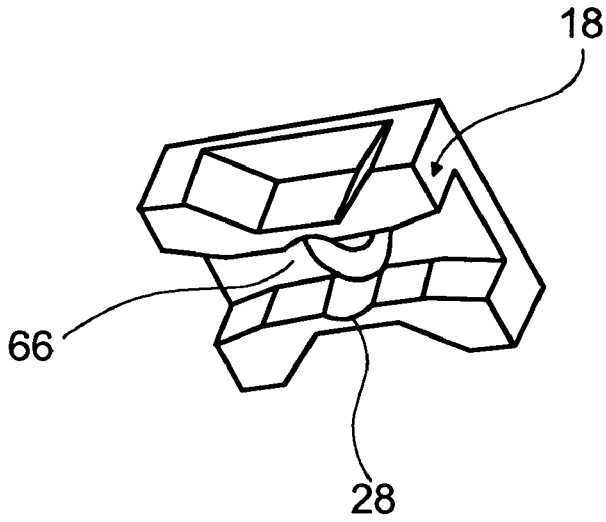
Figure 10:
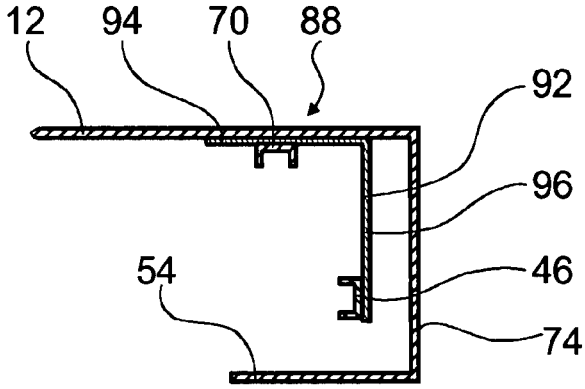
Figure 11:
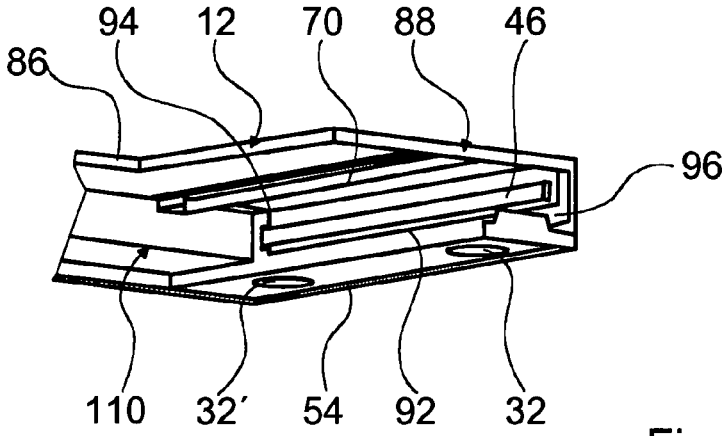
Figure 12:
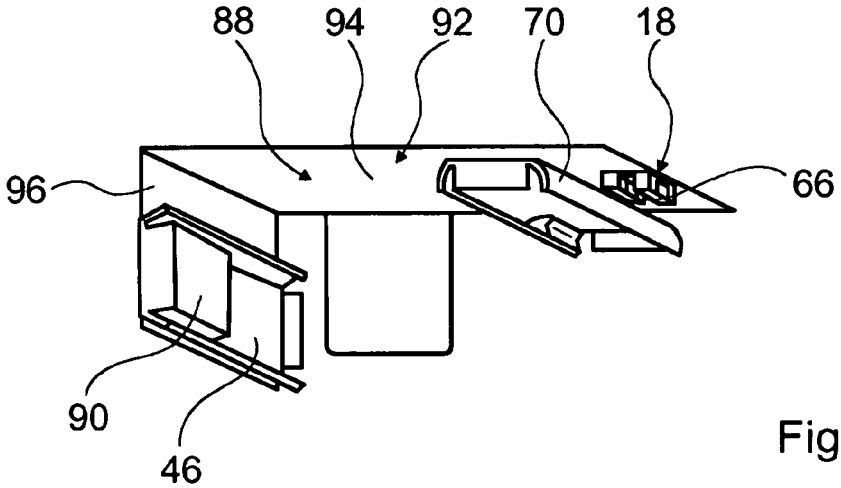
Figure 13:
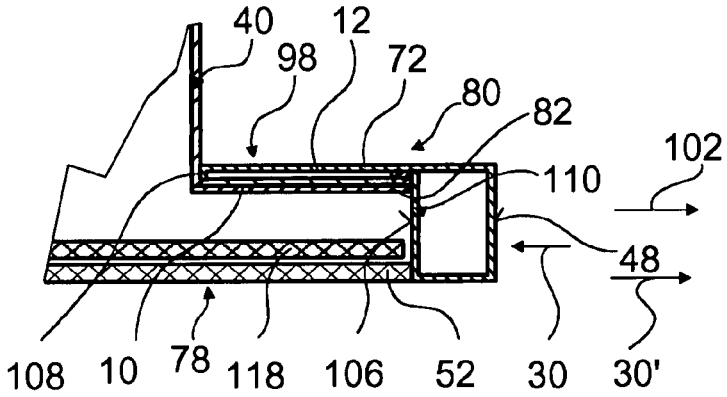
Figure 14:
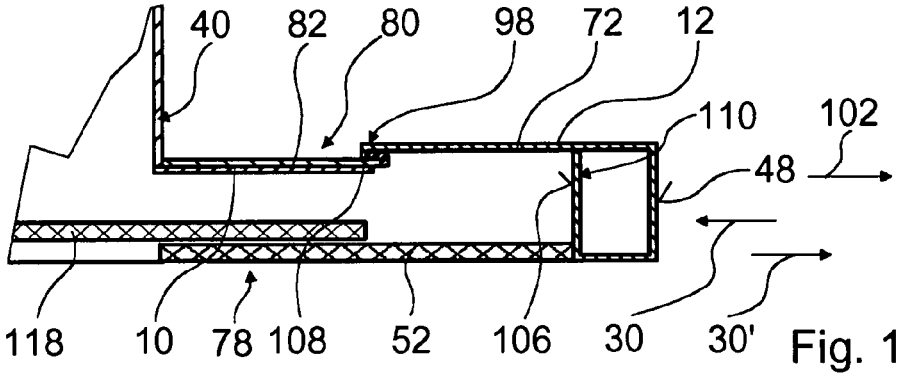
Figure 15:
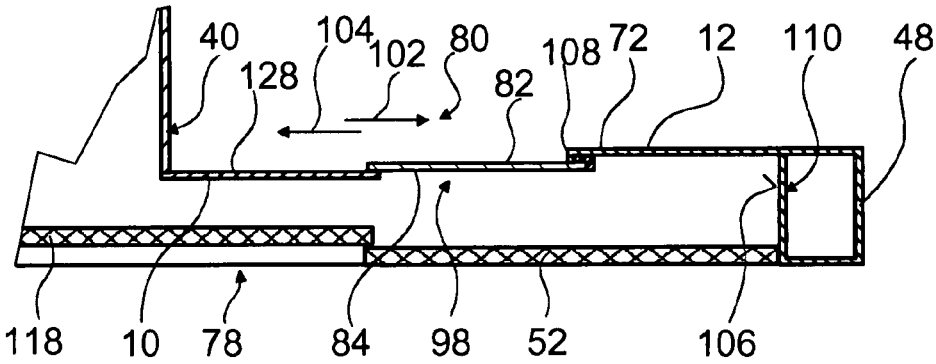
Figure 16:
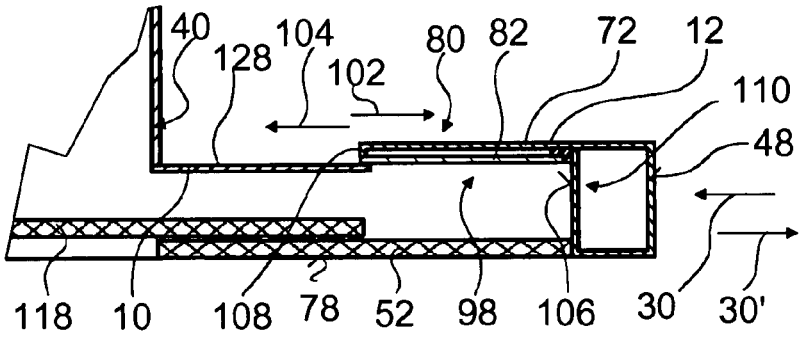
Figure 17:
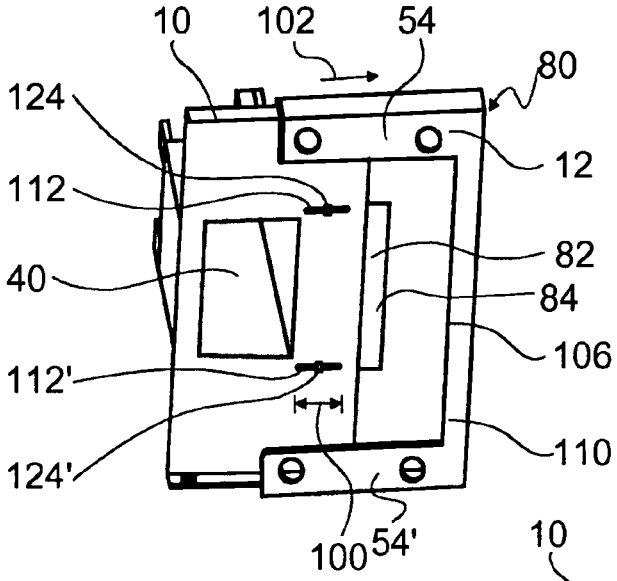
Figure 18:
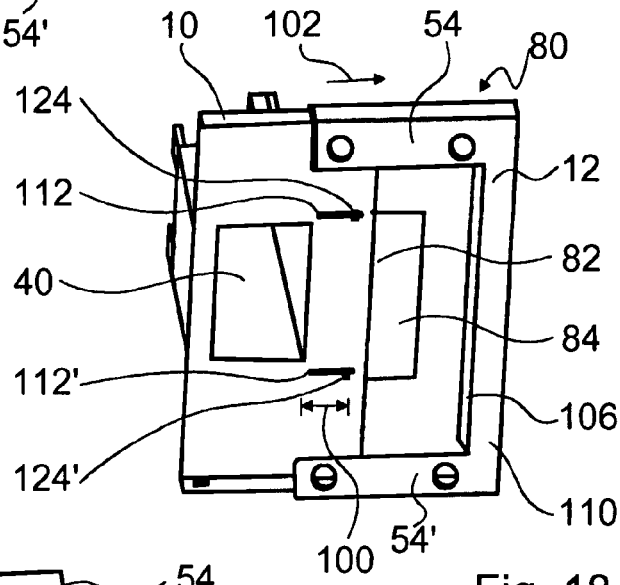
Figure 19:
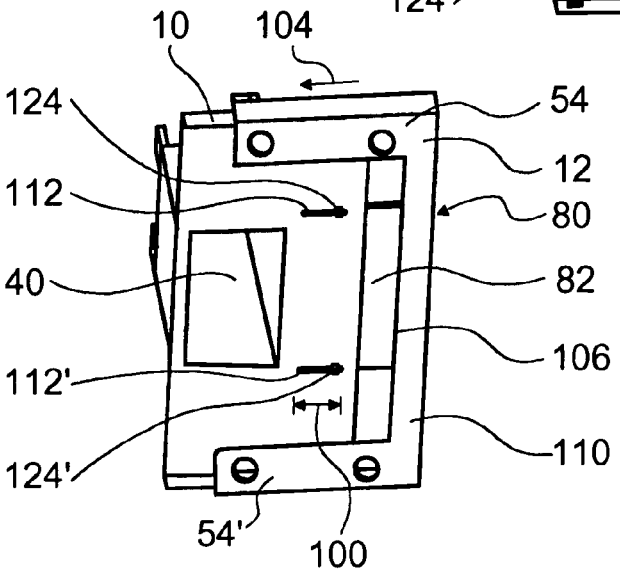
Figure 20:
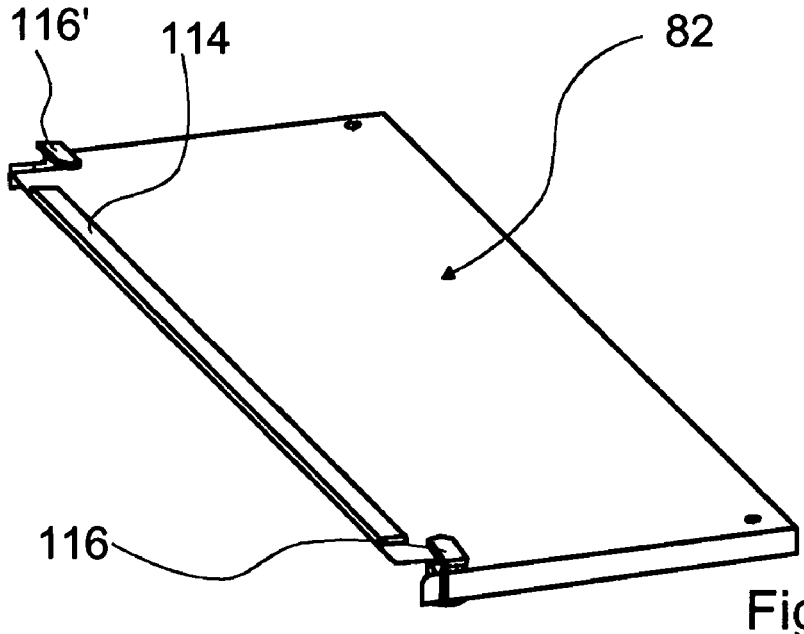
Figure 21:
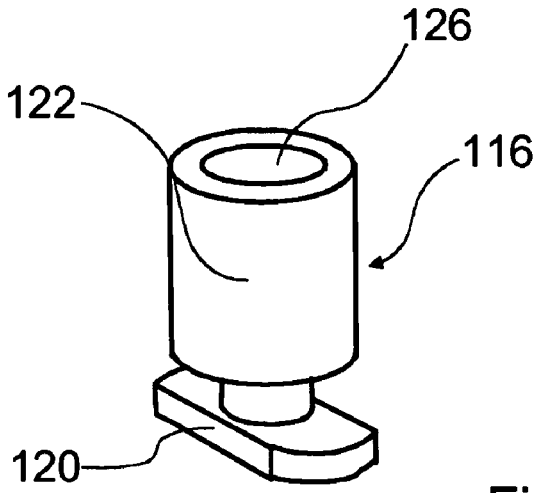

FIG. 11 the part of the guidance apparatus from FIG. 10 in a perspective internal view of a second body-section, FIG. 12 a support element as well as two guide rails of the guidance apparatus from FIGS. 10 and 11, FIG. 13 the kitchen extractor device from FIGS. 1-12 in a schematic cross sectional view in the rest position, FIG. 14 the kitchen extractor device from FIGS. 1-13 in a schematic cross-sectional view in a mid position during a pulling-out movement, FIG. 15 the kitchen extractor device from FIGS. 1-14 in a schematic cross-sectional view in a fully extended stop position, FIG. 16 the kitchen extractor device from FIGS. 1-15 in a schematic cross-sectional view in a mid position during a pushing-in movement, FIG. 17 the kitchen extractor device from FIGS. 1-16 in a view at an angle from below during a pulling-out movement, FIG. 18 the kitchen extractor device from FIGS. 1-17 viewed at an angle from below in the locked position, FIG. 19 the kitchen extractor device from FIGS. 1-18 viewed at an angle from below during a pushing-in movement, FIG. 20 a cover element of the kitchen extractor device from FIGS. 1-19 and FIG. 21 a spacing element of the kitchen extractor device from FIGS. 1-20.

FIG. 1 shows a kitchen device embodied as an chimney cooker hood or a kitchen extractor device for mounting on a kitchen wall over a cooking facility not shown here. The kitchen extractor device is essentially shaped like a horizontal flat cuboid with a rectangular steam extraction channel 40 mounted on it, in which a fan 42 and different filter elements 44 are arranged. The fan 42 is intended to suck steam out of an area below the kitchen extractor device. The cube-shaped, lower area of the kitchen extractor device forms a two-part body 80, comprising two body sections 10, 12. The first body section 10 is permanently connected to the steam extraction channel 40 and in the mounted state also permanently to a wall of the kitchen which includes the kitchen extractor device. The second body section 12 is supported displaceably on a total of four guide rails 46, 46', 70, 70' on the first, fixed body section 10.

In the mounted state, the second body section 12 surrounds or encloses the first, fixed body section 10 in all directions which are transversal to a direction 30 pointing in the direction of a kitchen wall. Further the second body section 12 covers the first body section 10 in a direction 30', opposite the direction 30 so that the second body section 12 forms a front section 48 on which a control panel 50 with a number of controls embodied as push buttons are arranged. An operator of the kitchen extractor device can use the controls to actuate the fan 42 and an illumination device 34 (FIG. 2) of the kitchen extractor device. Displacement directions are both the direction 30 as also the direction 30' opposite to the direction 30.

The first body section 10 includes as a major component a support plate, which in the mounted state is attached horizontally on the wall. The second body section 12 forms overall all transversal outer faces 72-78 of the body 80 aligned transversally to the displacement direction 30, and these are an upper face 72, a lower face 78 and side surfaces 74, 76. The second body section 12 thus also covers with its upper face 72, especially in the pushed-in state, an upper face 128 and a front face not explicitly shown here or the side of the first body section 10 facing away from direction 30.

The upper face 72 of the second body section 12 features a U-shaped recess 86 which is penetrated in the rest position by the steam extraction channel 40. If an operator moves the second body section 12 in a pulling-out movement 102 in the direction 30', after 100 mm displacement the edge of the recess 86 slides over the front edge of the first body section 10, so that the edge of the recess 86 and the front edge of the first body section 10 define a rectangular opening 84. The kitchen extractor device includes a movable or displaceable cover element 82 relative to both body sections 10, 12 for covering the opening 84.

Figure 2:
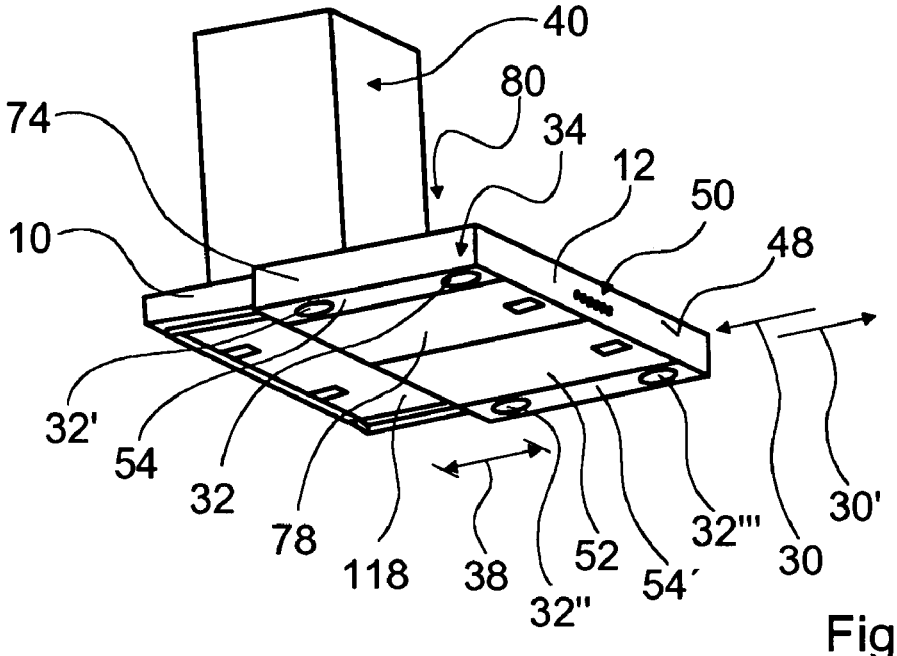
Figure 3:
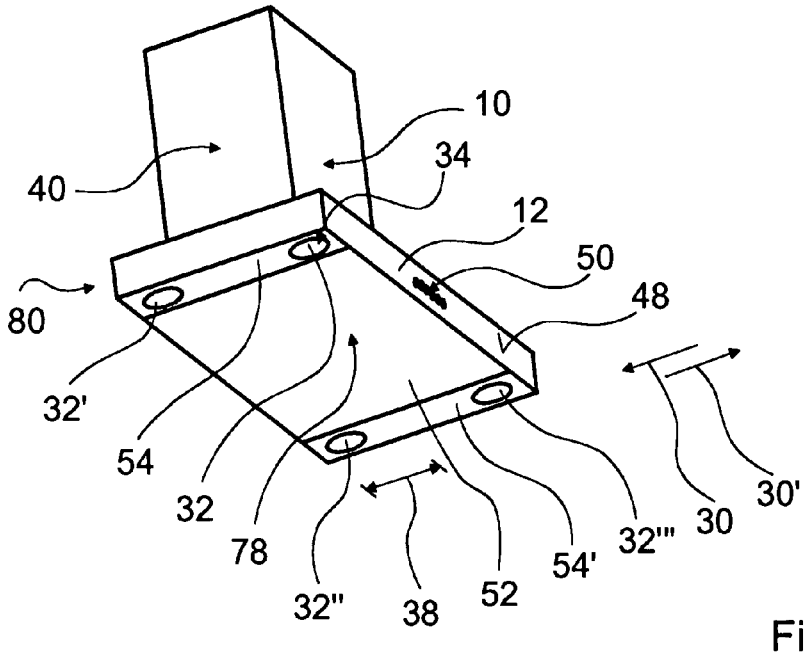

The lower face 78 of the second body section 12 is formed by a replaceable filter element 52 which, in the pushed-in state, which corresponds to a rest position, forms a part of a lower face of the body 80 which is temporarily supplemented by two strips 54, 54', in which retaining means 32-32 embodied as round holes for holding the illumination device 34 are provided (FIGS. 2 and 3). The illumination device 34 is composed of four manually adjustable Halogen spotlights.

The second body section 12 is movable in the direction 30 or in the direction 30' opposite the direction 30. The upper face 72, the front face 48, the side surfaces 74, 76 and the strips 54, 54' of the second body section 12 are formed in one piece as punched/formed metal sections from a stainless steel sheet, with second body section 12 having an easy-to-clean stainless steel surface.

Figure 4:
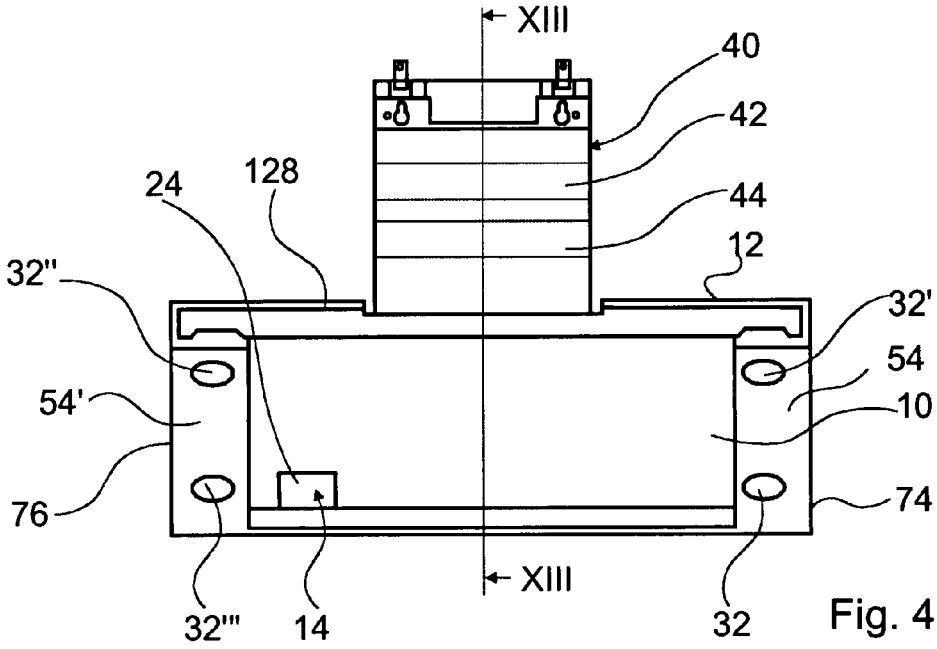

FIG. 4 shows an inner area of the kitchen extractor device with a further filter element 52 and an inner cladding of the first, fixed body section 10. The inner cladding features a smaller cladding medium 24 which is attached to the inner cladding to allow easy release. The cladding means 24 is used cover a locking apparatus 14 and protect it against vapor or steam, which is used to lock or to latch the second body section 12 in the stop position or end position and for variable delimitation of the scope of movement 38 of the second body section 12 in the sense of an adjustable stop element.

Figure 5:
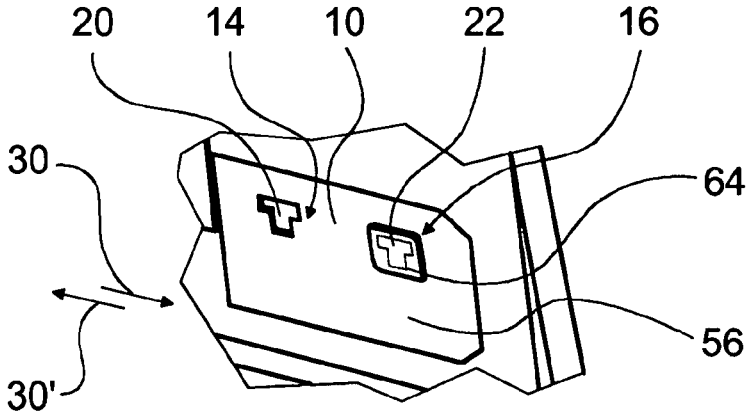

FIG. 5 shows the locking apparatus 14 with the cladding means 24 removed. In a support element 56 made of sheet metal are arranged two holders 20, 22 offset horizontally to each other embodied as U-shaped recesses, in which during the installation of the kitchen extractor a locking means 16 can be inserted and which in a manner described below, are assigned to a stop position or an end setting and are used to delimit a variable of the scope of movement 38.

In the configuration shown the locking means 16 is inserted into the mount 22 which is covered by it. If the locking means 16 is inserted into the mount 20 it forms an end stop which delimits the scope of movement 38 such that an overall depth of the body 80 in the locking position of end setting amounts to 550 mm, whereas the total depth amounts to 600 mm, if the locking means 16 is inserted into the holder 22. If the locking means 16 is not inserted into any of the mounts 20, 22 the scope of movement 38 is delimited by an end stop integrated into the guide rail 46 with an end stop and a locking means 90 and the overall depth in the stop position amounts to 650 mm. This means that the installer can chose between three different overall depths of locking positions and the kitchen extractor device can be adapted to the circumstances of a kitchen or to the wishes of an operator.

To insert the locking means 16 embodied as a latching bolt into the holder 22 this is initially introduced into the upper, transverse part of the T form of the holder 22 and pressed vertically downwards, with the locking means 16 being clamped via a groove 58 (FIG. 8) into a lower bar-shaped part of the T form of the holder 22. The locking means 16 essentially consists of a base 64, which in the inserted state rests on the support element 56 and prevents the locking means 16 slipping through the mount 22 and of a part 62 protruding into the space between the first body section 10 and the second body section 12 with the function of a latching bolt. The part 62 has a cross-section which tapers in the direction of the support element 56 which creates a clamping effect between the locking means 16 and the support element 56.

The support element 56 is part of the first stationary body section 10 and is connected to this. The same thus applies in the inserted state to the stop means 16. Also fixed to the support element 56 is a first, stationary part of the guide rail known per se 70, of which the second, movable part is connected to the second, movable body section 12. The two parts of the guide rail 70 are supported so that they can move in relation to each other by rollers not shown here.

Figure 6:
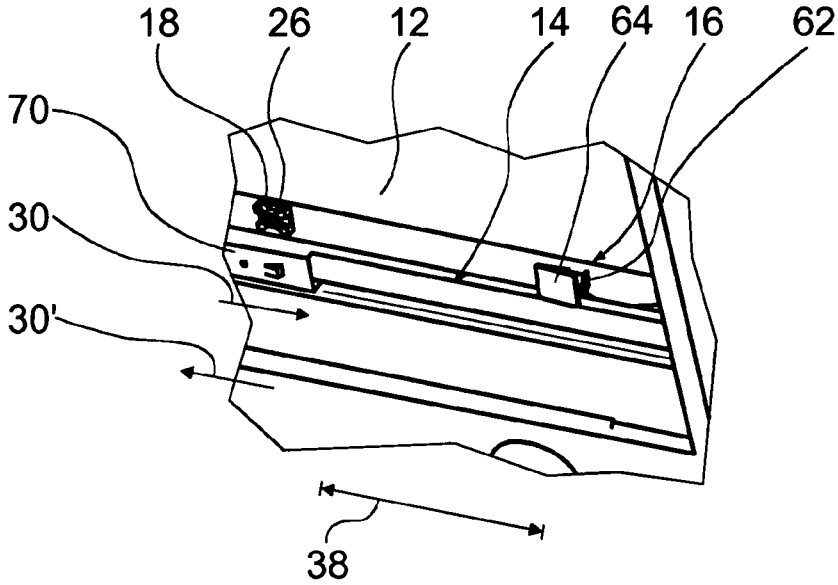
Figure 7:
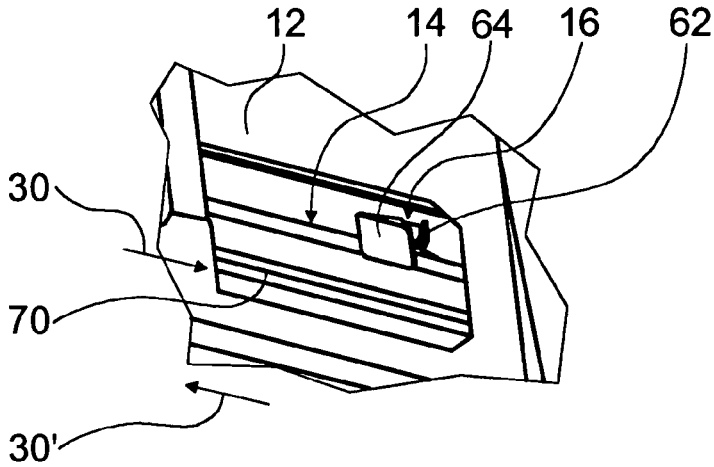

A further locking means 18 which is embodied as a locking lug and which corresponds to the locking means 16 is glued to an inner side of the outer second body section 12, in that both locking means 16, 18 a create a locking connection between the first body section 10 and the second body section 12 (FIGS. 6 and 7).

If an operator pulls the kitchen extractor device in the direction 30', the locking means 18 moves onto the locking means 16 until the part 62 of the locking means 16 which protrudes into the space between the body sections 10, 12 which has a fish-shaped cross-section, penetrates with a tip 60 into a central gap 66 of the locking means 18 which has a slightly smaller width than the fish-shaped cross-section in the area of its body 26 (FIGS. 8 and 9). The body 26 forms a locking means for locking the second body section 12 in the locking position or in the final position. The gap 66, at its end facing towards the locking means 16 or facing away from the direction 30 has a funnel-shaped widening, which facilitates introducing the tip 60 into the column 66 and a widening of the gap 66 by a wedge shape of the body 26 and is further suitable for compensating for installation tolerances.

Both locking means 16, 18 are made from elastic plastics and deform so that the body 26 pushes in the direction 30 into the column 66. The gap 66 has in its center a latching means embodied as a widened-out section 28 into which the body 26 engages, if the locking position is reached. A T-shaped end area 68 of the part 62 then strikes against the locking means 18 and prevents the locking means 16 with the application of a latching force being able to slide completely through the gap 66. The side walls of the locking means 18 are weakened externally in the area of the widened-out section 28, to increase their deformability in the transversal direction.

If the operator pushes in the second body section 12, applying the latching force in the direction 30, the body 26 slides out of the widened-out section 28 and the latching connection is released.

On the side opposite the guide rail 46 the kitchen extractor device features a similar guide rail symmetrical to the guide rail 46'. These two symmetrical guide rails 46, 46' arranged on each side are used to guide the second body section 12 horizontally and are supplemented by a third guide rail 70 and by a fourth guide rail 70' which are used for vertical guidance. Integrated into the guide rail 46, in addition to the latching means 90, is a reset means 36 embodied as a ramp with a spring-loaded roller not shown explicitly here, which returns the second body section 12 automatically in the direction 30 into a rest position or into a completely pushed-in position. The definition of a vertical position should be designated here as a guide into the horizontal.

The guide rails 46, 46', 70, 70" form a guide facility 88 made of two symmetrical sections, of which the left section viewed from the front includes the guide rails 46, 70 and is shown in more detail in FIG. 10 in a schematic diagram. The description is restricted to the left-hand part of the guide apparatus 88 shown and can be transferred equally to the symmetrically mirrored right-hand part of the guide apparatus 88.

Glued into the outer casing of the second body section 12 embodied from punched/formed parts is an angled support element 92 formed from elastic metal, which is aligned in parallel to the direction of movement 30 and to which the guide rails 46, 70 are attached from inside. The guide rail 70, which is provided for vertical guidance of the movement of the second body section 12, is attached in this case to a horizontally aligned leg 94 of the support element 92, whereas the guide rail 46, which is intended for horizontal guidance of the movement of the second body section 12 is attached to a free, vertically aligned leg 96 of the support element 92. The vertical leg 96 is able to be deflected elastically in a horizontal direction perpendicular to the direction of movement 30, so that tolerance compensation is obtained (FIG. 10).

FIG. 11 shows the arrangement of the support element 92 in the second, movable body section 12 and in addition a housing part 110 arranged behind the front of the second body section 12, in which electronic components of the operating panel 50 are arranged. As well as the guide rails 46, 70 the locking means 18 is also attached to the support element 92 (FIG. 12).

FIGS. 13-16 show the kitchen extractor device in a greatly schematic sectional view. In the rest position (FIG. 13) the filter element 52, which is connected to the second, movable body section 12, lies below a filter element 118, which is of an identical design to the filter element 52 and is connected to the first, fixed body section 10.

If an operator pulls a second, outer body section 12 by 100 mm in the direction 30', a carrier element 108 embodied as a folded edge of the recess 86 engages with a corresponding carrier element embodied as a sliding element 114 on the cover element 82 (FIG. 14).

The cover element 82 is freely movable both relative to the first body section 10 and also relative to the second body section 12, but in normal operation always lies on one of the carrier elements 106, 108 of a guidance facility 98, so that mobility is provided in each case in one of the directions 30, 30'.

If the operator continues the pulling out movement 102, the guidance facility 98 including the carrier element 108, guides the cover element 82 during an end part of the pulling out movement 102 in the direction 30' until the stop position is reached (FIG. 15). In the locked position the filter element 52 forms a front part of the lower face 78 of the body 80, while the filter element 118 forms a rear part 78 of the lower face of the body 80, so that both filter elements 52, 118 essentially cover an entire depth of the body 80.

The end part of puling-out movement 102 makes up at most a half of the entire pulling-out movement 102, with the entire amount depending on the choice of locking position or the insertion position of the locking means 16. The completely pulled-out configuration shown in FIG. 15 is only achievable without an insertion of the locking means 16 and corresponds to a latching configuration of the latching means 90 of the guide rail 46.

If the operator pushes the second body section 12 starting from the locking position, in a pushing-in movement 104 in the direction 30, 100 mm before the end of the pushing-in movement 104 an inner edge of the housing part 110, which forms the carrier element 106 of the guidance apparatus 98 engages with the cover element (FIG. 16).

If the operator continues the pushing-in movement 104 that has been started, the guidance facility 98 or the carrier element 106 guides the cover element 82 during an end part of the pushing-in movement 104 in the direction 30, until the rest position is reached (FIG. 13). The end part of the pushing-in movement 104 makes up at most half of the pushing-in movement 104 with the precise amount depending on the choice of the locking position.

FIGS. 17-19 show the kitchen extractor device in different configurations during a pushing-in movement 104 and a pulling-out movement 102 viewed at an angle from below, with the filter elements 52, 118 not shown to aid clarity.

Arranged in the first, fixed body section 10 are two stop elements 112, 112' embodied as slots, which guide a movement of the cover element 82 and a restrict a freedom of movement 100 of the cover element 82.

To this end spacing elements 116, 116' are latched into the side slots of the cover element 82 embodied as a metal plate, which ensure a gap between the cover element 82 and the first, fixed body section 10 and make it easier for the cover element 82 to slide on the first body section 10. The spacing elements 116, 116' comprise a head 120, which is locked into the slots on the cover element 82 and a spacing collar 122 with a central opening 126 (FIG. 21), into which during installation pins 124, 124' are pressed, into which the slots of the stop elements 112, 112' also engage. The slide element 114 facilitates a relative displacement between the cover element 82 and the second body section 12 and at the same time seals the kitchen extractor device off from the outside space.

REFERENCE SYMBOLS

10 Body section
12 Body section
14 Locking device
16 Locking means
18 Locking means
20 Recess
22 Recess
24 Cladding means
26 Body
28 Widened-out section
30 Direction
32 Retaining means
34 Illumination device
36 Return means
38 Scope of movement
40 Extraction channel
42 Fan
44 Filter element
46 Guide rail
48 Front
50 Control panel
52 Filter element
54 Strip
56 Support element
58 Groove
60 Tip
62 Part
64 Base
66 Gap
68 End area
70 Guide rail
72 External face
74 External face
76 External face
78 External face
80 Body
82 Cover element
84 Opening
86 Cutout
88 Guide facility
90 Latching means
92 Support element
94 Leg
96 Leg
98 Guide facility
100 Freedom of movement
102 Pulling-out movement
104 Pushing-in movement
106 Driver element
108 Driver element
110 Housing part
112 Stop element
114 Slide element
116 Spacer element
118 Filter element
120 Head
122 Spacing collar
124 Pin
126 Opening
128 Upper side

The invention claimed is:

1. A kitchen extractor device comprising: a body including a first body section adapted to be mounted in a fixed manner to a support structure, and a second body section displaceably mounted relative to the first body section, the second body section being displaceably movable relative to the first body section along a displacement direction from a rearward position into a forward position and being displaceably movable relative to the first body section along a direction opposite to the displacement direction from the forward position into the rearward position, and the second body section having an external face forming portion that at least partly forms an external face of the kitchen extractor device, the external face forming portion extending in a direction generally parallel to the displacement direction of the second body section, wherein the extractor device further comprises a cover element slidably displaceable relative to the first body section and relative to the second body section for covering an opening arising from a relative displacement of the body sections, wherein the second body section at least partly encloses the first body section, and wherein the second body section is capable of being pushed over the first body section.

2. The kitchen extractor device as claimed in claim 1, wherein at least one filter element is arranged in the second body section.

3. The kitchen extractor device as claimed in claim 2, wherein the filter element forms at least a part of the external face that is in transversal alignment with the displacement direction.

4. The kitchen extractor device as claimed in claim 1, wherein the second body section, in the rest position, covers at least a part of the upper face of the first body section.

5. The kitchen extractor device as claimed in claim 1, wherein the second body section, at least in the rest position, covers at least a part of the front face of the first body section.

6. The kitchen extractor device as claimed in claim 1, wherein the second body section encloses the first body section at least in all directions transversal to said displacement direction.

7. The kitchen extractor device as claimed in claim 1, wherein at least the second body section has a stainless steel surface.

8. The kitchen extractor device as claimed in claim 1, wherein the opening is delimited by a cutout in the second body section, which in a rest position is penetrated by an extraction channel of the first body section.

9. The kitchen extractor device as claimed in claim 1, wherein at least one control panel is arranged on the second body section.

10. The kitchen extractor device as claimed in claim 1, wherein the external face forming portion of the second body section includes external top, bottom, front and side faces that form external faces of the kitchen extractor device which at least partly cover respective, top, bottom, front and side faces of the first body section.

11. The kitchen extractor device as claimed in claim 1, wherein there are no gaps between the first and second body sections in either the rearward or forward positions that are visible along upper, lower and side surfaces of the body.

12. The kitchen extractor device as claimed in claim 1, wherein the cover is slidable to cover a gap between corresponding portions of the first and second body sections.

13. The kitchen extractor device as claimed in claim 1, wherein the first body section is positioned adjacent an extraction channel for exhaust gases, and wherein the cover element at least partly forms a passage such that exhaust gases in use are sequentially directed from the second body section, along the cover element, to the first body section and to the extraction channel.

14. A kitchen extractor device with a body, comprising a first body section designed to be mounted in a fixed manner and a second body section which can be displaced in a displacement direction relative to the first body section, wherein the second body section at least partly forms an external face extending in a direction generally in alignment with the displacement direction of the body, wherein the second body section at least partly encloses the first body section, and wherein the second body section is adapted to be pushed over the first body section, wherein the first body section includes a vertically oriented steam extraction channel including a fan and an exhaust exit, and the second body section includes a generally horizontally extending passage for steam, the first and second body sections forming an extraction path for exhausting steam generated through the exhaust exit in the first body section, wherein the first body section is at least partially received within the second body section when the second body section is positioned in a closed position.

15. The kitchen extractor device as claimed in claim 14, further comprising at least one filter element arranged in the second body section.

16. The kitchen extractor device as claimed in claim 15, wherein the filter element forms at least a part of the external face that is in transversal alignment with the displacement direction.

17. The kitchen extractor device as claimed in claim 14, wherein the second body section, in the closed position, covers at least a part of the upper face of the first body section.

18. The kitchen extractor device as claimed in claim 14, wherein the second body, section, at least in the closed position, covers at least a part of the front face of the first body section.

19. The kitchen extractor device as claimed in claim 14, wherein the second body section encloses the first body section at least in all directions transversal to the displacement direction.

20. The kitchen extractor device as claimed in claim 14, wherein at least the second body section has a stainless steel surface.

21. The kitchen extractor device as claimed in claim 14, further comprising a cover element displaceable relative to the first body section and relative to the second body section to cover an opening arising from relative displacement of the body sections.

22. The kitchen extractor device as claimed in claim 21, wherein the opening is delimited by a cutout in the second body section, which in the rest position is penetrated by an extraction channel of the first body section.

23. The kitchen extractor device as claimed in claim 21, wherein the cover is slidable to cover a gap between corresponding portions of the first and second body sections.

24. The kitchen extractor device as claimed in claim 22, wherein exhaust gases are sequentially directed from the second body section, along the cover, through the first body section, and through the extraction channel.

25. The kitchen extractor device as claimed in claim 14, further comprising at least one control panel arranged on the second body section.

26. The kitchen extractor device as claimed in claim 14, wherein there are no gaps between the first and second body sections in either the rearward or forward positions that are visible from front view along upper, lower and side surfaces of the body.

27. The kitchen extractor device as claimed in claim 14, wherein top, bottom and/or side faces of the second body section at least partly cover corresponding exterior top, bottom and/or side faces of the first body section.

28. The kitchen extractor device as claimed in claim 27, wherein the top, bottom and side faces of the second body section at least partially cover the corresponding exterior top, bottom and side faces of the first body section.

29. A kitchen extractor device comprising: a body including a first body section adapted to be mounted in a fixed manner to a support structure and a second body section displaceably mounted relative to the first body section, the second body section being displaceably movable relative to the first body section along a displacement direction from a rearward position into a forward position and being displaceably movable relative to the first body section along a direction opposite to the displacement direction from the forward position into the rearward position, and the second body section having an external face forming portion that at least partly covers the first body section and forms external top, bottom and side faces of the kitchen extractor device that, at least in the rearward position, overlap with corresponding top, bottom and side portions of the first body section, such that when pulled out towards the forward position, no visible gaps appear between the faces of the second body section and the corresponding side portions of the first body section.

30. A kitchen extractor device comprising: a body including a first body section adapted to be mounted in a fixed manner to a support structure, and a second body section displaceably mounted relative to the first body section, the second body section being displaceably movable relative to the first body section along a displacement direction from a rearward position into a forward position and being displaceably movable relative to the first body section along a direction opposite to the displacement direction from the forward position into the rearward position, and the second body section having an external face forming portion that at least partly forms an external face of the kitchen extractor device, the external face forming portion extending in a direction generally parallel to the displacement direction of the second body section, wherein the extractor device further comprises a cover element slidably displaceable relative to the first body section and relative to the second body section for covering an opening arising from a relative displacement of the body sections, wherein the second body section at least partially encloses the first body section, and wherein the second body section encloses the first body section at least in all directions transversal to said displacement direction.

31. A kitchen extractor device with a body, comprising a first body section designed to be mounted in a fixed manner and a second body section which can be displaced in a displacement direction relative to the first body section, wherein the second body section at least partly forms an external face extending in a direction generally in alignment with the displacement direction of the body, wherein the second body section includes an upper face that, in a closed position, covers at least a part of an upper face of the first body section that extends in the displacement direction, wherein the first body section includes a vertically oriented steam extraction channel including a fan and an exhaust exit, and the second body section includes a generally horizontally extending passage for steam, the first and second body sections forming an extraction path for exhausting steam generated through the exhaust exit in the first body section.

32. The kitchen extractor device as claimed in claim 31, wherein the first body section is at least partially received within the second body section when the second body section is positioned in the closed position.

33. A kitchen extractor device with a body, comprising a first body section designed to be mounted in a fixed manner and a second body section which can be displaced in a displacement direction relative to the first body section, wherein the second body section at least partly forms an external face extending in a direction generally in alignment with the displacement direction of the body, wherein the second body section encloses the first body section at least in all directions transversal to the displacement direction, wherein the first body section includes a vertically oriented steam extraction channel including a fan and an exhaust exit, and the second body section includes a generally horizontally extending passage for steam, the first and second body sections forming an extraction path for exhausting steam generated through the exhaust exit in the first body section.

34. The kitchen extractor device as claimed in claim 33, wherein the first body section is at least partially received within the second body section when the second body section is positioned in a closed position.

35. A kitchen extractor device comprising: a body including a first body section adapted to be mounted in a fixed manner to a support structure, and a second body section displaceably mounted relative to the first body section, the second body section being displaceably movable relative to the first body section along a displacement direction from a rearward position into a forward position and being displaceably movable relative to the first body section along a direction opposite to the displacement direction from the forward position into the rearward position, and the second body section having an external face forming portion that at least partly forms an external face of the kitchen extractor device, the external face forming portion extending in a direction generally parallel to the displacement direction of the second body section, wherein the extractor device further comprises a cover element slidably displaceable relative to the first body section and relative to the second body section for covering an opening arising from a relative displacement of the body sections, wherein the external face forming portion of the second body section includes external top, bottom, front and side faces that form external faces of the kitchen extractor device which at least partly cover respective, top, bottom, front and side faces of the first body section.

36. A kitchen extractor device with a body, comprising a first body section designed to be mounted in a fixed manner and a second body section which can be displaced in a displacement direction relative to the first body section, wherein the second body section at least partly forms an external face extending in a direction generally in alignment with the displacement direction of the body, wherein the second body section at least partly encloses the first body section, and wherein top, bottom and/or side faces of the second body section at least partly cover corresponding exterior top, bottom and/or side faces of the first body section, wherein the first body section includes a vertically oriented steam extraction channel including a fan and an exhaust exit, and the second body section includes a generally horizontally extending passage for steam, the first and second body sections forming an extraction path for exhausting steam generated through the exhaust exit in the first body section wherein the first body section is at least partially received within the second body section when the second body section is positioned in a closed position.

* * * * *